US009797362B2

(12) United States Patent
Nagata

(10) Patent No.: US 9,797,362 B2
(45) Date of Patent: Oct. 24, 2017

(54) ELECTRONIC CONTROL UNIT AND COMPUTER PROGRAM

(71) Applicant: DENSO CORPORATION, Kariya, Aichi-pref. (JP)

(72) Inventor: Kouji Nagata, Kariya (JP)

(73) Assignee: DENSO CORPORATION, Kariya (JP)

( * ) Notice: Subject to any disclaimer, the term of this patent is extended or adjusted under 35 U.S.C. 154(b) by 12 days.

(21) Appl. No.: 15/149,473

(22) Filed: May 9, 2016

(65) Prior Publication Data

US 2017/0058853 A1 Mar. 2, 2017

(30) Foreign Application Priority Data

Aug. 28, 2015 (JP) ..... 2015-169080

(51) Int. Cl.
*F02N 11/10* (2006.01)
*F02N 11/08* (2006.01)

(52) U.S. Cl.
CPC ..... *F02N 11/108* (2013.01); *F02N 11/087* (2013.01); *F02N 11/0862* (2013.01); *F02N 2200/043* (2013.01)

(58) Field of Classification Search
CPC .... F02N 11/08; F02N 11/108; F02N 11/0862; F02N 11/087; F02N 11/10; F02N 2200/043; F02D 41/221; F02D 41/222; F02D 41/22
USPC ..... 123/179.25; 701/107; 73/114.59
See application file for complete search history.

(56) References Cited

FOREIGN PATENT DOCUMENTS

JP 2012-202309 A 10/2012

*Primary Examiner* — Hai Huynh
(74) *Attorney, Agent, or Firm* — Posz Law Group, PLC

(57) ABSTRACT

A starter control apparatus outputs a conduction command to a starter relay when an engine start request is generated and starts driving of a starter. After the engine is started, when a condition for executing the failure diagnosis processing is satisfied, the starter control apparatus outputs a non-conduction command to a starter cutoff relay and diagnoses the starter cutoff relay for failure. The starter control apparatus determines that the starter cutoff relay is normal when a voltage applied to the starter after notification of the non-conduction command to the starter cutoff relay does not exceed a predetermined voltage. The starter control apparatus determines that the starter cutoff relay is abnormal when the voltage applied to the starter exceeds the predetermined voltage.

13 Claims, 3 Drawing Sheets

ELECTRONIC CONTROL UNIT AND COMPUTER PROGRAM

CROSS REFERENCE TO RELATED APPLICATION

This application is based on Japanese patent application No. 2015469080 filed on Aug. 28, 2015, the content of which is incorporated herein by reference.

TECHNICAL FIELD

The present disclosure relates to an electronic control unit and a computer program for the electronic control unit.

BACKGROUND ART

A starter for starting an engine of a vehicle is connected to a power supply battery through a starter relay for driving the starter and a starter cutoff relay for preventing the starter from being driven by a circuit failure (for example, refer to JP 2012-202309 A).

A starter control apparatus for controlling a starter described above conventionally performs a failure diagnosis for the starter cutoff relay. That is, when engine starting is requested and a failure diagnosis condition is satisfied, the starter control apparatus supplies the starter relay with a current while rendering the starter cutoff relay to be non-conductive and compares a voltage applied to the starter with a predetermined voltage (0 volt). When the voltage applied to the starter does not exceed the predetermined voltage, the starter control apparatus determines that the starter cutoff relay is normal. When the voltage applied to the starter exceeds the predetermined voltage, the starter control apparatus determines that the starter cutoff relay is abnormal. After the failure diagnosis, the starter control apparatus supplies the starter cutoff relay with a current to start driving the starter while maintaining the current supply to the starter relay.

According to the configuration described above, the timing of starting driving of the starter is delayed by a period of performing the failure diagnosis relative to the timing of generation of the engine starting request. Thus engine starting operation need be improved.

SUMMARY

The present disclosure addresses the above-described problem and has an object to provide an electronic control unit, which performs a failure diagnosis for a switch part for fail-safe operation appropriately and improves starting operation of the engine.

According to one aspect, an electronic control unit is provided as a starter control apparatus for a vehicle, which includes a first switch part and a second switch part connected in series between an electric load for starting an engine of the vehicle and a power supply battery. The first switch part is for driving the electric load and the second switch part is for a fail-safe operation. The electronic control unit comprises a switch control part, a physical quantity detection part and a determination part. The switch control part outputs a conduction command and a non-conduction command to the first switch part and the second switch part of and controls the first switch part and the second switch part to be conductive and anon-conductive, respectively. The physical quantity detection part detects a physical quantity, which electrically affects on the electric load. The determination part determines whether the second switch part is normal or abnormal based on a detection result of the physical quantity detection part. As failure diagnosis processing, the switch control part outputs the conduction command to the first switch part upon determination of generation of an engine start request thereby to start driving of the electric load while rendering the second switch part to be conductive, and, after the engine is started, outputting the non-conduction command to the second switch part while rendering the first switch part to be conductive upon determination of satisfaction of condition for executing the failure diagnosis processing. The determination part determines, in the failure diagnosis processing, that the second switch part is normal when the physical quantity detected after the non-conduction command is outputted to the second switch part fails to exceed a predetermined value, and that the second switch part is abnormal when the physical quantity exceeds the predetermined value.

DETAILED DESCRIPTION OF THE EMBODIMENT

Figure 1:
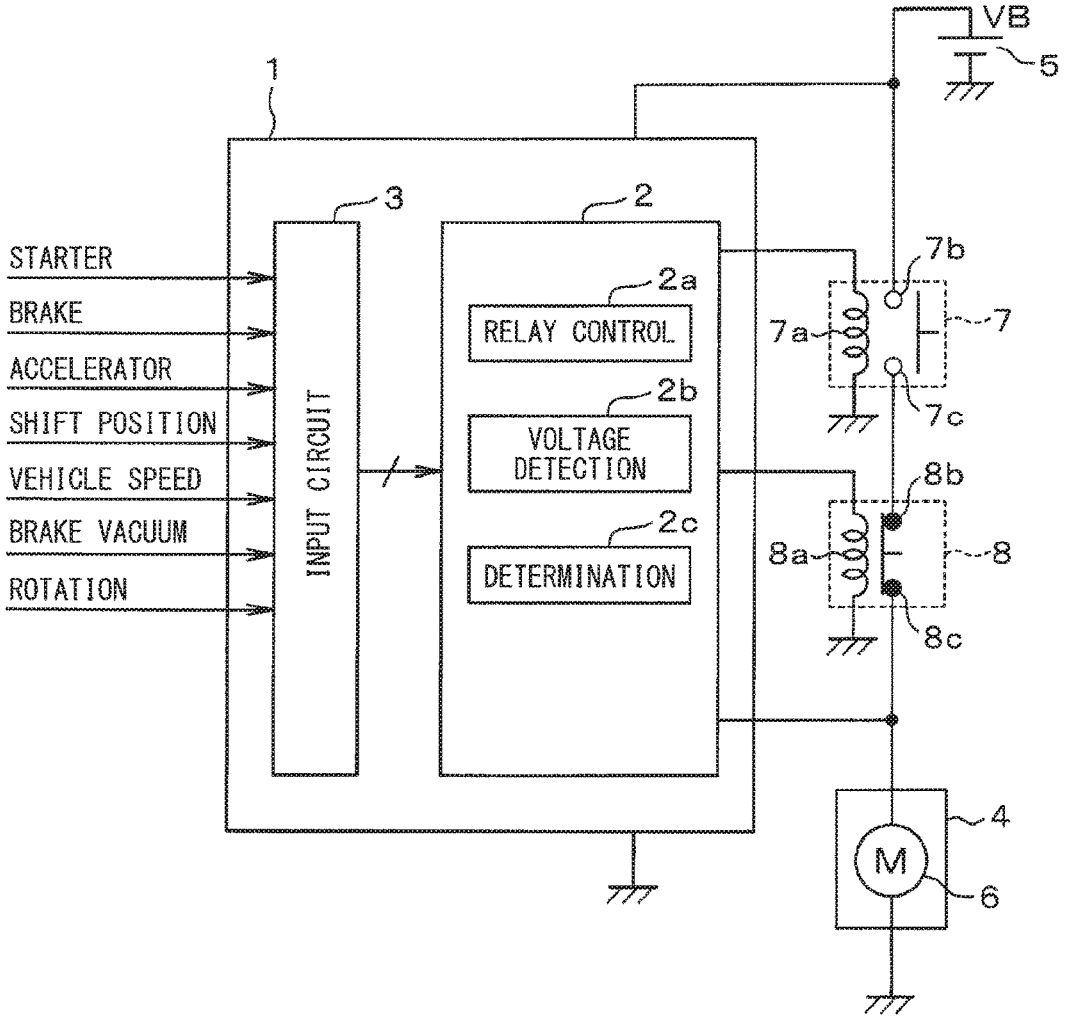
FIG. 1 is a block diagram showing a configuration of a starter control apparatus and peripheral parts according to one embodiment.

Referring to FIG. 1, a starter control apparatus 1 is configured by an ECU (electronic control unit), which includes a microcomputer 2 and an input circuit 3. The starter control apparatus 1 controls driving of a starter 4, which is an electric load provided to start an internal combustion engine (not shown) of a vehicle by cranking. The starter control apparatus 1 is connected to a positive terminal of a power supply battery 5 mounted in the vehicle and operates with power supply of a battery voltage VB from the positive terminal of the power supply battery 5. The battery voltage VB is about 12 volts in the present embodiment.

The input circuit 3 receives from external sides of the starter control apparatus 1 various signals, which are, for example, a starter signal, a brake signal, an accelerator signal, a shift position signal, a vehicle speed signal, brake vacuum signal and a rotation signal. The starter signal changes its level from a non-active level to an active level when a driver of the vehicle performs a starting operation. The starting operation is, for example, turning a mechanical key inserted into a key cylinder to a start position or pushing down a start button by the driver. The brake signal is generated by a sensor, which detects pressing down of a brake pedal. The accelerator signal is generated by a sensor, which detects pressing down of an accelerator pedal. The shift position signal is generated by a sensor, which detects a position of a shift lever. The vehicle speed signal is generated by a sensor, which detects a travel speed (that is, vehicle speed) of the vehicle. The brake vacuum signal is generated by a sensor, which detects a brake vacuum (that is, a vacuum pressure of a brake booster). The rotation signal is generated by a crankshaft sensor or a camshaft sensor, which detects rotation of the engine. The input circuit 3 receives these signals from the external sides of the starter control apparatus 1 and outputs the received signals to the microcomputer 2.

The starter 4 includes a motor 6, which is a motive power source for starting the engine by cranking. One terminal of the motor 6 is connected to the positive terminal of the power supply battery 5 through a power supply path, in which a starter relay 7 (first switch part) and a starter cutoff relay 8 (second switch part) are connected in series. The starter relay 7 forms a starter circuit for driving the starter 4. The starter cutoff relay 8 forms a starter cutoff circuit for fail-safe operation, which prevents the starter 4 from being driven upon an occurrence of a circuit failure or the like. The other terminal of the motor 6 is connected to a negative terminal (ground line) of the power supply battery 5 and grounded. The starter 4 includes a pinion gear (not shown), which is driven by the motor 6 to reciprocally move between a position for engagement with a ring gear of the engine and a position for disengagement from the ring gear. In the starter 4, the motor 6 is powered to rotate under a state that the pinion gear is moved to the position of engagement with the ring gear. Thus the rotary force of the motor 6 is transferred to the ring gear through the pinion gear for cranking the engine at the time of engine starting.

The starter relay 7 has a coil 7*a* and a pair of connection terminals 7*b* and 7*c*. One terminal and the other terminal of the coil 7*a* are connected to the microcomputer 2 and the ground, respectively. The connection terminal 7*b* is connected to the positive terminal of the power supply battery 5. The connection terminal 7*c* is connected to the starter cutoff relay 8. The starter relay 7 is a normally-open type relay. The starter rely 7 normally remains in the open state between the pair of connection terminals 7*b* and 7*c* (that is, relay non-conduction state) with the coil 7*a* being supplied with no current. The starter relay 7 closes the pair of connection terminals 7*b* and 7*c* (that is, relay conduction state) with the coil 7*a* being supplied with current.

The starter cutoff relay 8 has a coil 8*a* and a pair of connection terminals 8*b* and 8*c*. One terminal and the other terminal of the coil 8*a* are connected to the microcomputer 2 and grounded, respectively. The connection terminal 8*b* is connected to the starter relay 7. The connection terminal 8*c* is connected to the starter 4. The starter cutoff rely 8 is a normally-closed type relay. The starter cutoff relay 8 normally remains in the closed state between the pair of connection terminals 8*b* and 8*c* (that is, relay conduction state) with the coil 8*a* being supplied with no current. The starter cutoff relay 8 opens the pair of connection terminals 8*b* and 8*c* (that is, relay non-conduction state) with the coil 8*a* being supplied with current.

The microcomputer 2 includes a CPU (central processing unit), a ROM (read only memory), a RAM (random access memory) and an I/O (input/output). The microcomputer 2 executes a computer program stored in a non-volatile storage medium thereby to execute processing corresponding to the stored computer program and control entire operation of the starter control apparatus 1. The processing corresponding to the computer program includes failure diagnosis according to a first diagnosis method and failure diagnosis according to a second diagnosis method. The microcomputer 2 includes, as functions to execute the processing corresponding to the computer program, a relay control part 2*a* (switch control part), a voltage detection part 2*b* (physical quantity detection part) and a determination part 2*c*.

The relay control part 2*a* controls conduction and non-conduction of each of the starter relay 7 and the starter cutoff relay 8. Specifically, the relay control part 2*a* renders the starter relay 7 conductive by turning on a switch such as a MOSFET (metal-oxide-semiconductor field-effect transistor), which is provided between the microcomputer 2 and the coil 7*a* although not shown, and outputting a conduction command and renders the starter relay 7 non-conductive by turning off the switch and outputting a non-conduction command (cutoff command).

Further, the relay control part 2*a* renders the starter cutoff relay 8 non-conductive (cutoff) by turning on a switch such as a MOSFET (metal-oxide-semiconductor field-effect transistor), which is provided between the microcomputer 2 and the coil 8*a* although not shown, and outputting a non-conduction command and renders the relay conductive by turning off the switch and outputting a conduction command.

The voltage detection part 2*b* detects the voltage applied to the starter 4 as a physical quantity, which affects on the starter 4 electrically.

The determination part 2*c* determines whether the starter cutoff relay 8 is normal or abnormal based on a detection result of the voltage detection part 2*b*. Specifically, the determination part 2*c* determines that the starter cutoff relay 8 is normal when the voltage applied to the starter 4 is not higher than and fails to exceed 0 volt (predetermined value and predetermined voltage). The determination part 2*c* determines that the starter cutoff relay 8 is abnormal when the voltage applied to the starter 4 is higher than and exceeds 0 volt (that is, the physical quantity is larger than the predetermined value).

Figure 2:
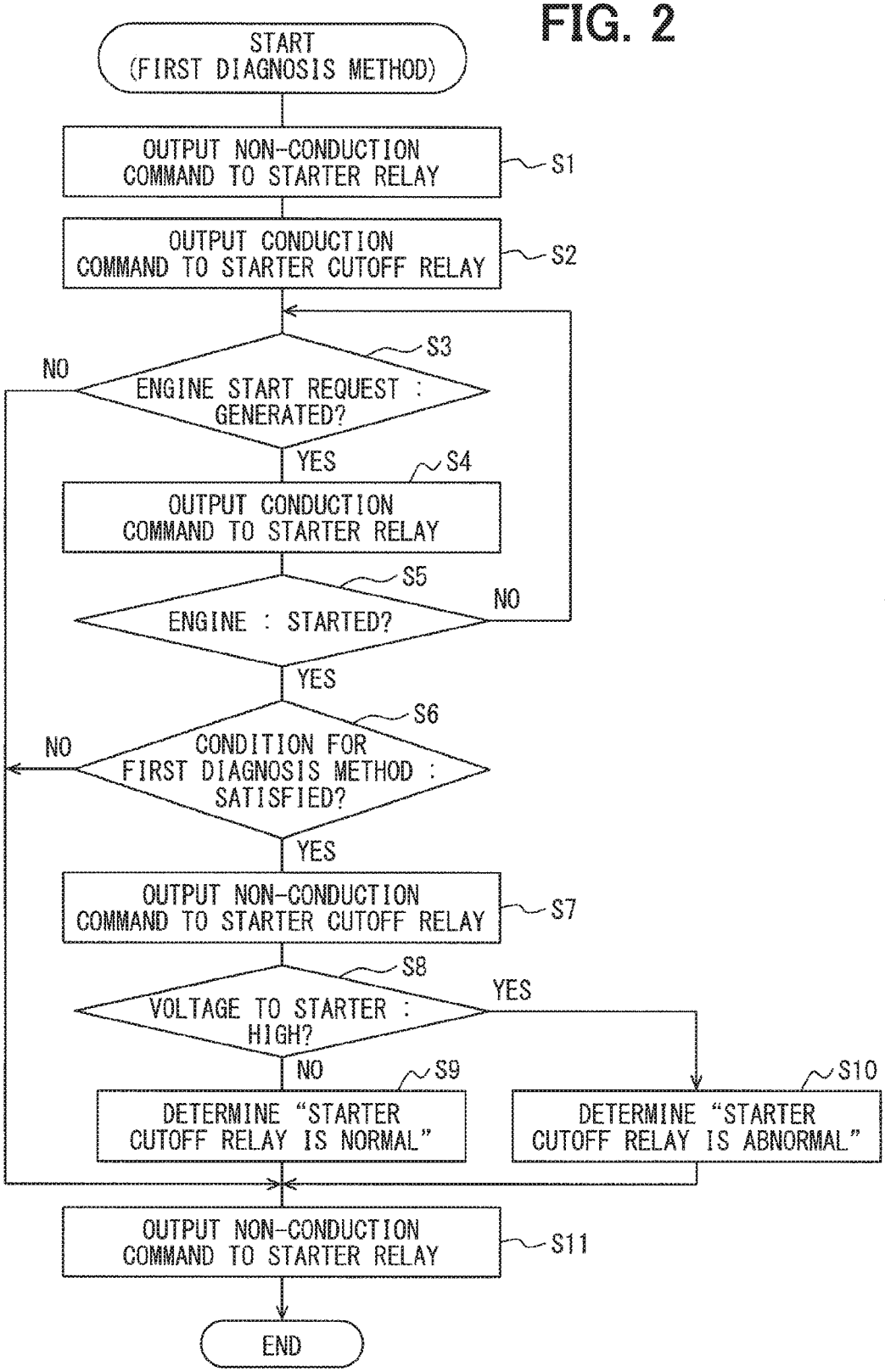
FIG. 2 is a flowchart showing failure diagnosis according to a first diagnosis method executed in the embodiment.
Figure 3:
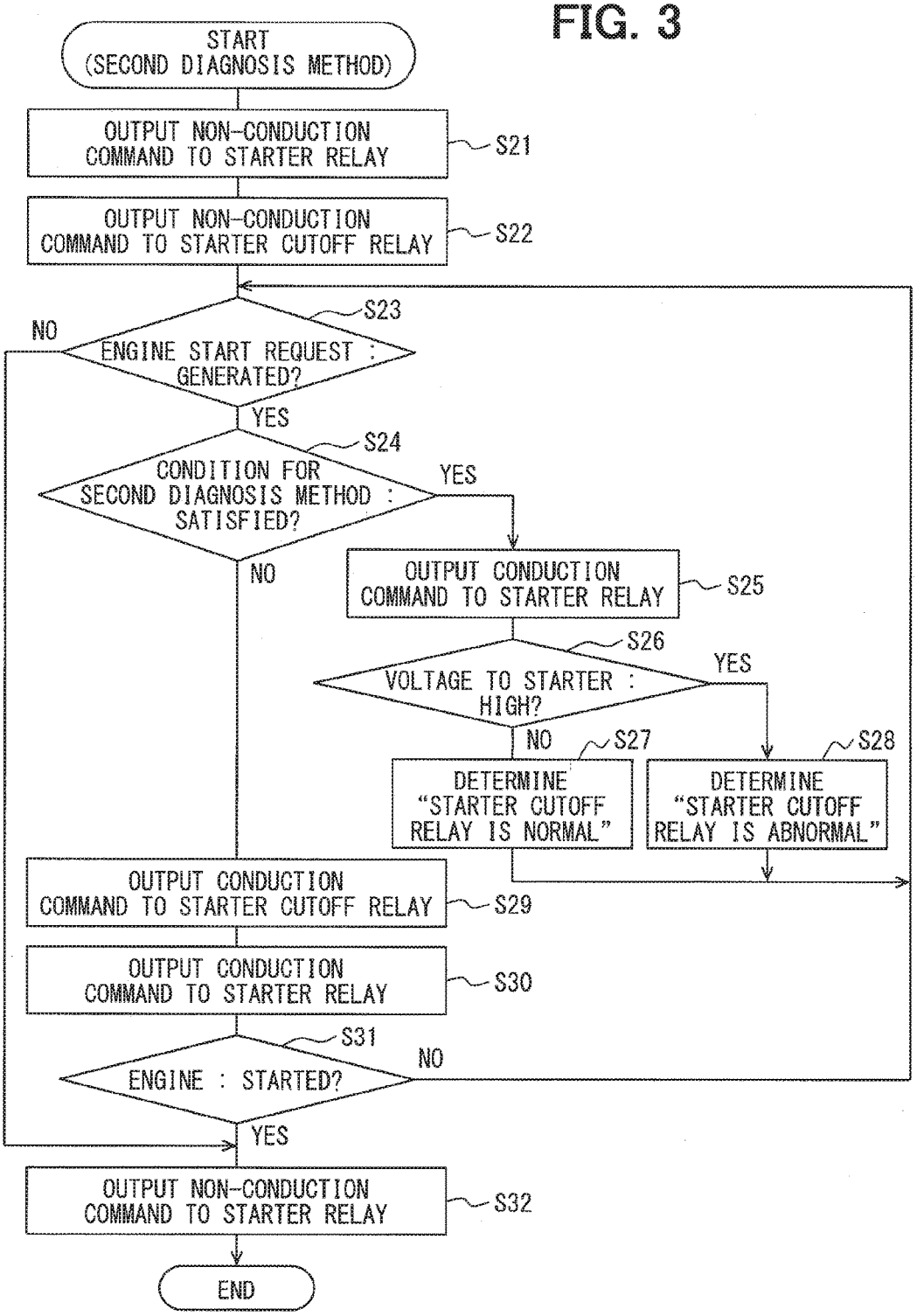
FIG. 3 is a flowchart showing failure diagnosis according to a second diagnosis method executed in the embodiment.

An operation of the above-described embodiment will be described below with reference to FIG. 2 and FIG. 3, in which "S" indicates a step. The microcomputer 2 executes the failure diagnosis according to the first diagnosis method and the failure diagnosis according to the second diagnosis method as the failure diagnosis processing for the starter cutoff relay 8. Each of the diagnosis method will be described in sequence. It is assumed that the starter relay 7 is normal.

(1) While the starter control apparatus 1 is in operation, the microcomputer 2 monitors at every predetermined interval whether a start condition for executing the failure diagnosis according to the first diagnosis method is satisfied. When the microcomputer 2 determines that the start condition for the failure diagnosis according to the first diagnosis method is satisfied, the microcomputer 2 starts the failure diagnosis according to the first diagnosis method. After starting the failure diagnosis according to the first diagnosis method, the microcomputer 2 outputs the non-conduction command to the starter relay 7 (S1) and the conduction command to the starter cutoff relay 8 (S2).

The microcomputer 2 then checks whether an engine start request is generated based on the starter signal (S3, first process). That is, the microcomputer 2 checks whether the starter signal is changed from the non-active level to the active level in response to the starting operation performed by the driver of the vehicle. When the engine start request is not generated (S3: NO), the microcomputer 2 outputs the non-conduction command to the starter relay 7 (S11) and finishes the failure diagnosis according to the first diagnosis method. When the engine start request is once generated (S3: YES) and the conduction command is outputted to the starter relay 7 (S4) but the engine start request is withdrawn (S3: NO) before a determination of engine starting (S5: NO), the microcomputer 2 outputs the non-conduction command to the starter relay 7 to prevent the conduction command from being continuously outputted to the starter relay 7, that is, to prevent voltage supply to the starter 4.

When the engine start request is generated (S3: YES), the microcomputer 2 outputs the conduction command to the starter relay 7 (S4, second process). When the conduction command is outputted to the starter relay 7 and the current is supplied to the starter relay 7, the voltage supply is started from the power supply battery 5 to the starter 4 through the starter cutoff relay 8, which is normally conductive, and the voltage supplied to the starter 4 changes from 0 volt to the battery voltage VB. As a result, the pinion gear is moved to the position of engagement with the ring gear, the current is supplied to the motor 6 of the starter 4 and the motor 6 rotates. The rotary force of the motor 6 is transferred to the ring gear through the pinion gear for cranking of the engine. With this cranking of the engine, the engine is started with fuel injection and ignition controlled by the other ECU (not shown) provided as an engine control apparatus.

The microcomputer 2 then checks whether the engine is started (that is, complete combustion is attained) (S5). When a rotation speed value detected based on the rotation signal rises to be higher than a predetermined value, the microcomputer 2 determines that the engine has been started (S5: YES) and checks whether the condition for executing the failure diagnosis according to the first diagnosis method is satisfied (S6: third process). When the condition for executing the failure diagnosis according to the first diagnosis method is satisfied (S6: YES), the microcomputer 2 outputs the non-conduction command to the starter cutoff relay 8 (S7; fourth process). The microcomputer 2 monitors the voltage applied to the starter 4 at this time.

When the non-conduction command is outputted to the starter cutoff relay 8, the starter cutoff relay 8 is rendered non-conductive with the starter relay 7 being maintained in the conductive state as far as the starter cutoff relay 8 is normal. Thus the voltage supply from the power supply voltage 5 to the starter 4 is stopped and the voltage applied to the starter 4 changes from the battery voltage VB to 0 volt. When the starter cutoff relay 8 is abnormal, the starter cutoff relay 8 is not rendered non-conductive and continues to be conductive with the starter relay 7 being maintained to be conductive. Since the voltage supply from the power supply battery 5 to the starter 4 is not stopped but continued, the voltage supplied to the starter 4 remains to be equal to the battery voltage VB.

The microcomputer 2 compares the voltage applied to the starter 4 and monitored as described above with the predetermined voltage (0 volt) and checks whether the monitored voltage applied to the starter 4 is higher than the predetermined voltage (S8). When the voltage applied to the starter 4 is not higher than the predetermined voltage (S8: NO), the microcomputer 2 determines that the starter cutoff relay 8 is normal (59, fifth process). When the voltage applied to the starter 4 is higher than the predetermined voltage (S8: YES), the microcomputer 2 determines that the starter cutoff relay 8 is abnormal (S10: fifth process). The microcomputer 2 then outputs the non-conduction command to the starter relay 7 (S11) and finishes the failure diagnosis according to the first diagnosis method. When the starter relay 7 is rendered non-conductive in response to the non-conduction command to the starter relay 7, the voltage supply from the power supply battery 5 to the starter 4 is stopped. Since the voltage applied to the starter 4 falls from the battery voltage VB to 0 volt, the pinion gear is moved to the position for disengagement of the pinion gear from the ring gear.

When the condition for executing the failure diagnosis according to the first diagnosis method (S6: NO), the microcomputer 2 outputs the non-conduction command to the starter relay 7 (S11) and finishes the failure diagnosis according to the first diagnosis method. In this situation, the starter relay 7 is rendered non-conductive in response to the non-conduction command to the starter relay 7 and the voltage supply from the power supply battery 5 to the starter 4 is stopped. Since the voltage applied to the starter 4 falls from the battery voltage VB to 0 volt, the pinion gear is moved to the position for disengagement of the pinion gear from the ring gear.

As described above, in the failure diagnosis according to the first diagnosis method, the microcomputer 2 starts driving the starter 4 in response to the generation of the engine start request and then checks whether the condition for executing the failure diagnosis for the starter cutoff relay 8 is satisfied. Upon determination that the condition for executing the failure diagnosis according to the first diagnosis method is satisfied, the microcomputer 2 renders the starter cutoff relay 8 non-conductive while rendering the starter relay 7 conductive and checks whether the starter cutoff relay 8 is normal or abnormal. That is, the microcomputer 2 diagnoses the starter cutoff relay 8 on failure not before starting of the engine but after starting of the engine.

The microcomputer 2 may check the condition for executing the failure diagnosis processing according the first diagnosis method at any interval. That is, the microcomputer 2 may determine that the condition for executing the failure diagnosis according to the first diagnosis method is satisfied at every completion of engine starting. Alternatively, the microcomputer 2 may determine that the condition for executing the failure diagnosis according to the first diagnosis method is satisfied at one of plural completions of engine starting. Further, the microcomputer 2 may determine that the condition for executing the failure diagnosis according to the first diagnosis method is satisfied after a completion of engine starting from a vehicle travel of a predetermined distance (for example, 100 kilometers) or an elapse of a predetermined period (for example, one week), which follows previous satisfaction of the condition for executing the failure diagnosis according to the first diagnosis method.

(2) While the starter control apparatus 1 is in operation, the microcomputer 2 monitors whether a start condition for executing the failure diagnosis according to the second diagnosis method is satisfied. When the microcomputer 2 determines that the start condition for the failure diagnosis according to the second diagnosis method is satisfied, the microcomputer 2 starts the failure diagnosis according to the second diagnosis method. The start condition is determined to be satisfied when, for example, either one of the numbers that the starter cutoff relay 8 is determined to be abnormal and normal reaches a predetermined value (for example, 10 times) in the failure diagnosis according to the first diagnosis method. After starting the failure diagnosis according to the second diagnosis method, the microcomputer 2 outputs the non-conduction command to the starter relay 7 (S21) and the non-conduction command to the starter cutoff relay 8 (S22).

The microcomputer 2 then checks whether the engine start request is generated (S23). When the engine start request is not generated (S23: NO), the microcomputer 2 outputs the non-conduction command to the starter relay 7 (S32) and finishes the failure diagnosis according to the second diagnosis method.

When the starter signal is changed from the non-active level to the active level in response to the starting operation performed by the driver of the vehicle, the microcomputer 2 determines that the engine start request is generated (S23: YES) and checks whether the condition for executing the failure diagnosis according to the second diagnosis method is satisfied (S24: sixth process). As described above, the start condition is, for example, whether either one of the numbers that the starter cutoff relay 8 is determined to be abnormal and normal reaches a predetermined value (for example, 10 times) in the failure diagnosis according to the first diagnosis method. When the condition for executing the failure diagnosis according to the second diagnosis method is satisfied (S24: YES), the microcomputer 2 outputs the conduction command to the starter relay 7 (S25, seventh process). The microcomputer 2 monitors the voltage applied to the starter at this time.

When the conduction command is outputted to the starter relay 7, the starter cutoff relay 8 is rendered non-conductive with the starter relay 7 being rendered conductive as far as the starter cutoff relay 8 is normal. Thus the voltage supply from the power supply battery 5 to the starter 4 continues to be stopped and the voltage applied to the starter 4 continues to be 0 volt. When the starter cutoff relay 8 is abnormal, the starter relay 7 is rendered conductive with the starter cutoff relay 8 continuing to be conductive without being not rendered non-conductive. Thus the voltage applied to the starter 4 changes from 0 volt to be equal to the battery voltage VB.

The microcomputer 2 compares the voltage applied to the starter 4 and monitored as described above with the predetermined voltage (0 volt) and checks whether the monitored voltage applied to the starter 4 is higher than the predetermined voltage (S26). When the voltage applied to the starter 4 is not higher than the predetermined voltage (S26: NO), the microcomputer 2 determines that the starter cutoff relay 8 is normal (S27, eighth process). When the voltage applied to the starter 4 is higher than the predetermined voltage (S26: YES), the microcomputer 2 determines that the starter cutoff relay 8 is abnormal (S28: eighth process). The microcomputer 2 executes step S23 again and checks whether the engine start request continues.

When the engine start request is present (S23: YES) and the condition for executing the failure diagnosis according to the second diagnosis method is not satisfied (S24: NO), the microcomputer 2 outputs the conduction command to the starter cutoff relay 8 (S29) and the conduction command is outputted to the starter relay 7 (S30). When the starter cutoff relay 8 is rendered conductive in response to the conduction command outputted to the starter cutoff relay 8 and the starter relay 7 is rendered conductive in response to the conduction command to the starter relay 7, the current is supplied to the starter relay 7. Thus the voltage supply is started from the power supply battery 5 to the starter 4 and the voltage supplied to the starter 4 changes from 0 volt to the battery voltage VB. As a result, the pinion gear is moved to the position for engagement with the ring gear, current is supplied to the motor 6 of the starter 4 and the motor 6 rotates. The rotary force of the motor 6 is transferred to the ring gear through the pinion gear for cranking of the engine. With this cranking of the engine, the engine is started with fuel injection and ignition controlled by the other ECU (not shown) provided as the engine control apparatus.

The microcomputer 2 then checks whether the engine is started (S31). When the rotation speed of the engine detected based on the rotation signal rises to be higher than the predetermined value and the engine is started (S31: YES), the microcomputer 2 outputs the non-conduction command to the starter relay 7 (S32) and finishes the failure diagnosis according to the second diagnosis method. In this situation, when the starter relay 7 is rendered non-conductive in response to the non-conduction command, the voltage supply from the power supply battery 5 to the starter 4 is stopped. Since the voltage applied to the starter 4 thus falls from the battery voltage VB to 0 volt, the pinion gear is moved to the position for disengagement of the pinion gear from the ring gear.

As described above, in the failure diagnosis according to the second diagnosis method, the microcomputer 2 checks whether the condition for executing the failure diagnosis according to the second diagnosis method is satisfied when the engine start request is generated. When the condition for executing the failure diagnosis according to the second diagnosis method is satisfied, the microcomputer 2 renders the starter relay 7 conductive while rendering the starter cutoff relay 8 non-conductive and checks whether the starter cutoff relay 8 is normal or abnormal. The microcomputer 2 then starts driving the starter after finishing the failure diagnosis processing. That is, differently from the failure diagnosis according to the first diagnosis method described above, the microcomputer 2 executes the failure diagnosis processing for the starter cutoff relay 8 before starting of the engine.

The microcomputer 2 may check the condition for executing the failure diagnosis processing according the second diagnosis method at any interval. That is, the microcomputer 2 may determine that the condition for executing the failure diagnosis according to the second diagnosis method is satisfied after every generation of the engine start request. Alternatively, the microcomputer 2 may determine that the condition for executing the failure diagnosis according to the second diagnosis method is satisfied at one of plural generations of engine start requests. Further, the microcomputer 2 may determine that the condition for executing the failure diagnosis according to the second diagnosis method is satisfied after the generation of the engine start request from a vehicle travel of a predetermined distance (for example, 100 kilometers) or an elapse of a predetermined period (for example, one week), which follows previous satisfaction of the condition for executing the failure diagnosis according to the second diagnosis method.

As described above, the present embodiment provides the following advantages.

In the failure diagnosis according to the first diagnosis method, when the engine start request is generated, the starter control apparatus 1 starts driving the starter 4 and performs the failure diagnosis for the starter cutoff relay 8 when the condition for executing the failure diagnosis according to the first diagnosis method is satisfied. It is thus possible to avoid a delay in starting the driving of the starter 4 relative to the generation timing of the engine start request and speedily start the engine. It is further possible to execute the failure diagnosis for the starter cutoff relay 8 appropriately while enhancing engine starting operation.

The starter control apparatus 1 outputs the non-conduction command to the starter relay 7 after checking whether the starter cutoff relay 8 is normal or abnormal. It is thus possible to avoid that the starter relay 7 is left continuously powered.

The starter control apparatus 1 determines that the condition for executing the failure diagnosis according to the first diagnosis method is satisfied at every completion of engine starting, at one of the plural completions of engine starting or at the completion of engine starting after the vehicle travel of a predetermined distance or the elapse of a predetermined period, which follows previous satisfaction of the condition for executing the failure diagnosis according to the first diagnosis method. It is thus possible to execute the failure diagnosis according to the first diagnosis method at an arbitrary frequency.

In the failure diagnosis according to the second diagnosis method, after the engine start request is generated, the starter control apparatus 1 performs the failure diagnosis for the starter cutoff relay 8 when the condition for executing the failure diagnosis according to the second diagnosis method is satisfied. By using both failure diagnosis according to the first diagnosis method and the second diagnosis method, it is possible to rectify erroneous diagnosis in the failure diagnosis according to the first diagnosis method. That is, since the failure diagnosis according to the first diagnosis method is executed after the engine is started, it is likely that the failure diagnosis according to the first diagnosis method is executed erroneously because of noise, which is generated by, for example, ignition sparks at the time of or after engine starting. However, by executing the failure diagnosis according to the second diagnosis method, it is possible to check whether the diagnosis result according to the first diagnosis method is reliable. Even when the first diagnosis method produces the diagnosis result erroneously, it is possible to save such an erroneous diagnosis result and enhance reliability of the failure diagnosis processing.

The starter control apparatus 1 executes the failure diagnosis according to the second diagnosis method, when at least one of the numbers of determinations that the starter cutoff relay 8 is normal and abnormal in the failure processing according to the first diagnosis method reaches the predetermined value. It is thus possible to determine at an arbitrary frequency whether the failure diagnosis according to the second diagnosis method need be executed, that is, whether the diagnosis result according to the first diagnosis method is true or not.

The starter control apparatus 1 determines that the condition for executing the failure diagnosis according to the second diagnosis method is satisfied after every completion of engine starting, after one of the plural completions of engine starting or after the completion of engine starting after the vehicle travel of a predetermined distance or the elapse of a predetermined period, which follows previous satisfaction of the condition for executing the failure diagnosis according to the second diagnosis method. It is thus possible to execute also the failure diagnosis according to the second diagnosis method at an arbitrary frequency.

The starter control apparatus is not limited to the exemplary embodiment described above but may be modified or varied further as exemplified below.

The starter relay 7 and the starter cutoff relay 8 are used for the switch parts for driving the starter 4 and for performing the fail-safe operation, respectively. Alternatively, semiconductor switches such as transistors may be used.

As the physical quantity, which electrically affects on the starter 4, the voltage applied to the starter 4 is detected. Alternatively, a current may be detected. That is, a current detection part may be provided for detecting a current supplied to the starter 4 in place of the voltage detection part. In this modification, in the failure diagnosis processing of the first diagnosis method, the determination part 2*c* determines that the starter cutoff relay 8 is normal when the current supplied after the notification of the non-conduction to the starter cutoff relay 8 does not exceed a predetermined current (0 A) and that the starter cutoff relay 8 is abnormal when the current exceeds the predetermined current. Further, in the failure diagnosis according to the second diagnosis method, the determination part 2*c* determines that the starter cutoff relay 8 is normal when the current supplied after the notification of the conduction command to the starter cutoff relay 8 does not exceed the predetermined current (0 A) and that the starter cutoff relay 8 is abnormal when the current exceeds the predetermined current. Still further, it is also possible to diagnose the starter cutoff relay 8 on failure by using both of the failure diagnosis processing by detection of the applied voltage and detection of the supplied current.

The relays 7 and 8 are connected to the positive terminals side of the power supply battery 5 relative to the starter 4, that is, in a high-side driving configuration. Alternatively, the relays 7 and 8 may be connected to the negative terminal side of the power supply battery 5, that is, in a low-side driving configuration. In the high-side driving configuration, the starter cutoff relay 8 can be diagnosed for failure in any cases of detection of the applied voltage and the supplied current to the starter 4. In the low-side driving configuration, the starter cutoff relay 8 can be diagnosed for failure in the case of detection of the supplied current.

The electronic control unit described above may be used for an idle-stop control system, which automatically stops and starts the engine. That is, the electronic control unit may be used for a system, in which the engine is stopped automatically when an automatic engine stop condition is satisfied and started automatically when an automatic engine start condition is satisfied. In this case, it may be checked whether the automatic engine stop condition and the automatic engine start condition are satisfied based on the brake signal, the accelerator signal, the shift position signal, the vehicle speed signal, the brake vacuum signal, the rotation signal and the like.

What is claimed is:

1. An electronic control unit for a vehicle, which includes a first switch part and a second switch part connected in series between an electric load for starting an engine of the vehicle and a power supply battery, the first switch part being for driving the electric load and the second switch part being for a fail-safe operation, the electronic control unit comprising:

a switch control part for outputting a conduction command and a non-conduction command to the first switch part and the second switch part of and controlling the first switch part and the second switch part to be conductive and anon-conductive, respectively;

a physical quantity detection part for detecting a physical quantity, which electrically affects on the electric load; and a determination part for determining whether the second switch part is normal or abnormal based on a detection result of the physical quantity detection part, wherein, as failure diagnosis by a first diagnosis method, the switch control part outputs the conduction command to the first switch part upon determination of generation of an engine start request thereby to start driving of the electric load while rendering the second switch part to be conductive, and, after the engine is started, outputting the non-conduction command to the second switch part while rendering the first switch part to be conductive upon determination of satisfaction of condition for executing the failure diagnosis according to the first diagnosis method, and the determination part determines, in the failure diagnosis according to the first diagnosis method, that the second switch part is normal when the physical quantity detected after the non-conduction command is outputted to the second switch part fails to exceed a predetermined value, and that the second switch part is abnormal when the physical quantity exceeds the predetermined value.

2. The electronic control unit according to claim 1, wherein:

the switch control part outputs the non-conduction command to the first switch part after the second switch part is determined to be normal or abnormal by the determination part.

3. The electronic control unit according to claim 1, wherein:

the switch control part determines that the condition for executing the failure diagnosis according to the first diagnosis method is satisfied after each starting of the engine.

4. The electronic control unit according to claim 1, wherein:

the switch control part determines that the condition for executing the failure diagnosis according to the first diagnosis method is satisfied after one of plural starting of the engine.

5. The electronic control unit according to claim 1, wherein:

the switch control part determines that the condition for executing the failure diagnosis according to the first diagnosis method is satisfied after starting of the engine, which follows a predetermined travel distance or a predetermined travel time elapse of the vehicle measured after previous determination that the condition for executing the failure diagnosis according to the first diagnosis method is satisfied.

6. The electronic control unit according to claim 1, wherein, as failure diagnosis according to a second diagnosis method:

the switch control part outputs the conduction command to the first switch part upon determination of the generation of the engine start request while rendering the second switch part to be non-conductive; and the determination part determines, in the failure diagnosis according to the second diagnosis method, that the second switch part is normal when the physical quantity detected after the conduction command is outputted to the first switch part fails to exceed the predetermined value, and that the second switch part is abnormal when the physical quantity exceeds the predetermined value.

7. The electronic control unit according to claim 6, wherein:

the switch control part executes the failure diagnosis according to the second diagnosis method, when at least one of numbers of determinations of the determination part that the second switch part is abnormal or normal.

8. The electronic control unit according to claim 6, wherein:

the switch control part determines that the condition for executing the failure diagnosis according to the second diagnosis method is satisfied after each generation of the engine start request.

9. The electronic control unit according to claim 6, wherein:

the switch control part determines that the condition for executing the failure diagnosis according to the second diagnosis method is satisfied after one of plural engine start requests.

10. The electronic control unit according to claim 6, wherein:

the switch control part determines that the condition for executing the failure diagnosis according to the second diagnosis method is satisfied after generation of the engine start request, which follows a predetermined travel distance or a predetermined travel time elapse of the vehicle measured after previous determination that the condition for executing the failure diagnosis according to the second method is satisfied.

11. The electronic control unit according to claim 1, wherein:

the physical quantity detection part includes a voltage detection part for detecting a voltage applied to the electric load; and the determination part determines that the second switch part is normal when the voltage fails to exceed a predetermined voltage and that the second switch part is abnormal when the voltage exceeds the predetermined voltage.

12. A computer program for a microcomputer of an electronic control unit for a vehicle, which includes a first switch part and a second switch part connected in series between an electric load for starting an engine of the vehicle and a power supply battery, the first switch part being for driving the electric load and the second switch part being for a fail-safe operation, the computer program comprising:

a first process for checking whether an engine start request is generated as failure diagnosis by a first diagnosis method;

a second process for outputting, upon determination that the engine start request is generated, a conduction command to the first switch part thereby to start driving of the electric load while rendering the second switch part to be conductive;

a third process for checking, after engine starting, whether a condition for executing the failure diagnosis according to the first diagnosis method is satisfied;

a fourth process for outputting, upon determination of the third process that the condition for executing the failure diagnosis according to the first diagnosis method is satisfied, a non-conduction command to the second switch part while rendering the first switch part to be conductive; and a fifth process for determining that the second switch part is normal when a physical quantity, which affects on the electric load and is detected after the non-conduction command is outputted to the second switch part by the fourth process, fails to exceed a predetermined value, and that the second switch part is abnormal when the physical quantity exceeds the predetermined value.

13. The computer program according to claim 12, further comprising:

as failure diagnosis by a second diagnosis method, a sixth process for checking whether a condition for executing failure diagnosis by a second diagnosis method is satisfied after generation of an engine start request;

a seventh process for outputting, upon determination of the sixth process that the condition for executing the failure diagnosis according to the second diagnosis method is satisfied, a conduction command to the first switch part while rendering the second switch part to be non-conductive; and an eighth process for determining that the second switch part is normal when the physical quantity, which is detected after the conduction command is outputted to the first switch part by the seventh process, fails to exceed the predetermined value, and that the second switch part is abnormal when the physical quantity exceeds the predetermined value.

* * * * *